United States Patent [19]

Nishimura et al.

[11] Patent Number: 4,523,858

[45] Date of Patent: Jun. 18, 1985

[54] COMBINED ELECTRONIC CALCULATOR AND ELECTRONIC ALARM TIMEPIECE

[75] Inventors: Toshio Nishimura, Joyo; Akitaka Morita, Shiki, both of Japan

[73] Assignee: Sharp Kabushiki Kaisha, Osaka, Japan

[21] Appl. No.: 354,757

[22] Filed: Mar. 4, 1982

[30] Foreign Application Priority Data

Mar. 6, 1981 [JP] Japan ..... 56-32700
Mar. 6, 1981 [JP] Japan ..... 56-32701

[51] Int. Cl.[3] ..... G04G 13/00
[52] U.S. Cl. ..... 368/272; 368/188
[58] Field of Search ..... 368/272, 273, 251, 69, 368/70, 75, 188

[56] References Cited

U.S. PATENT DOCUMENTS 4,073,133 2/1978 Earls et al. ..... 368/273
4,102,122 7/1978 Tanaka ..... 368/29
4,258,431 3/1981 Sekiya et al. ..... 368/188
4,368,989 1/1983 Kawashima ..... 368/273

*Primary Examiner*—Forester W. Isen
*Attorney, Agent, or Firm*—Birch, Stewart, Kolasch & Birch

[57] ABSTRACT

An electronic alarm timepiece comprises an alarm generation circuit for generating a plurality of alarm tones, and an alarm selection circuit for selecting a particular alarm tone from the plurality of alarm tones and for enabling generation of the particular alarm tone in response to the agreement between current time information and alarm time information, the selection of the particular alarm tone and the enabling of the generation of the particular alarm tone being carried out by a single operation of the alarm selection means. Preferably, an electronic calculator is incorporated within the electronic alarm timepiece.

7 Claims, 2 Drawing Figures

COMBINED ELECTRONIC CALCULATOR AND ELECTRONIC ALARM TIMEPIECE

BACKGROUND OF THE INVENTION

The present invention relates to a combined electronic calculator and electronic timepiece and, more particularly, to a combined electronic calculator and electronic alarm timepiece.

Conventionally, an alarm melody from an electronic timepiece is selected by actuating a slide switch for selecting tone and silence of the alarm melody or by electing a combination of a melody on-off switch and a melody switch for selecting the kind of alarm melody.

Conventionally, the size of the slide switch is too large to successfully miniaturize the timepiece. Further, this switch is costly. The combination of the melody on-off switch and the melody switch requires a two-step switching operation, which is rather troublesome.

Further, the melody on-off switch and the melody switch must be conventionally actuated while an alarm time is being set. Therefore, the melody selection operation can not be enabled, individually and independently of the alarm time setting operation.

Therefore, it is desired to simplify the melody selection system in the electronic timepiece as much as possible and enable the melody selection system to be individually activated.

SUMMARY OF THE INVENTION

Accordingly, it is an object of the present invention to provide an improved electronic alarm timepiece for enabling selection of a particular alarm melody with a single-step operation.

It is another object of the present invention to provide an improved combined electronic alarm timepiece for enabling selection of a particular alarm melody with a single-step operation.

It is a further object of the present invention to provide an improved electronic alarm timepiece for individually enabling selection of a particular alarm melody, independently of an alarm time setting operation.

Briefly described, in accordance with the present invention, an electronic alarm timepiece comprises an alarm generation means for generating a plurality of alarm tones, and an alarm selection means for selecting a particular alarm tone from the plurality of alarm tones and for enabling generation of the particular alarm tone in response to the agreement between current time information and alarm time information. The selection of the particular alarm tone and the enabling of the generation of the particular alarm tone is carried out by a single operation of the alarm selection means.

Preferably, one of the plurality of alarm tones is cyclically selected by the alarm selection means. An electronic calculator may be incorporated within the electronic alarm timepiece.

BRIEF DESCRIPTION OF THE INVENTION

Figure 1:
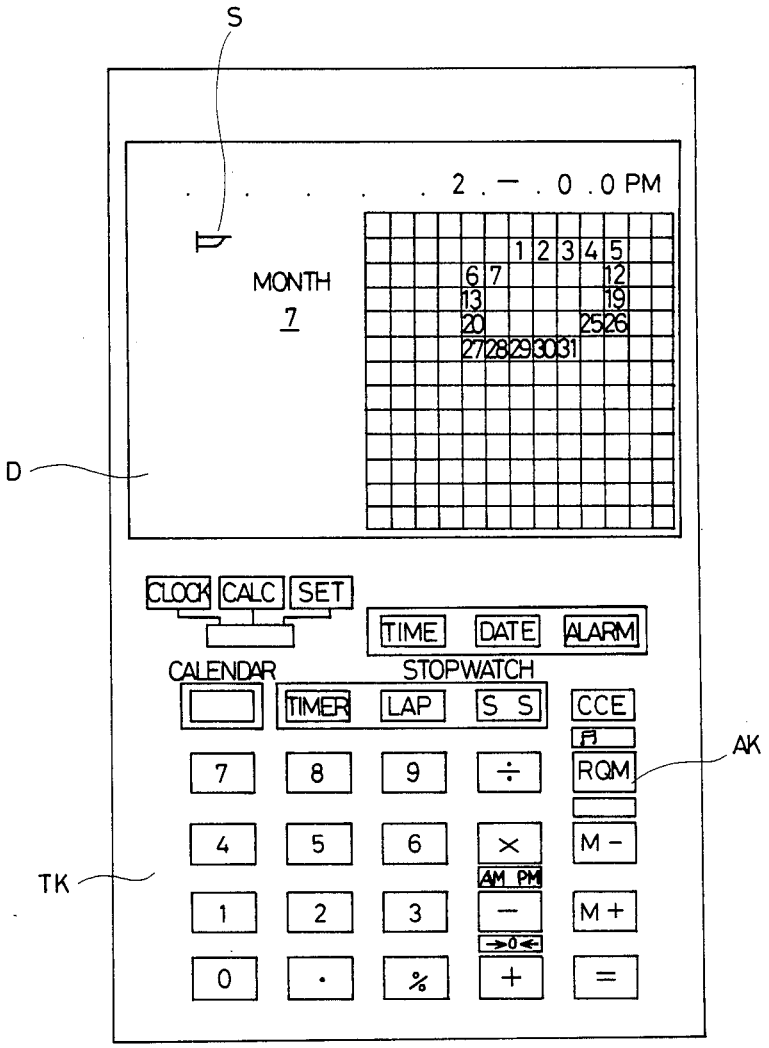
Figure 2:
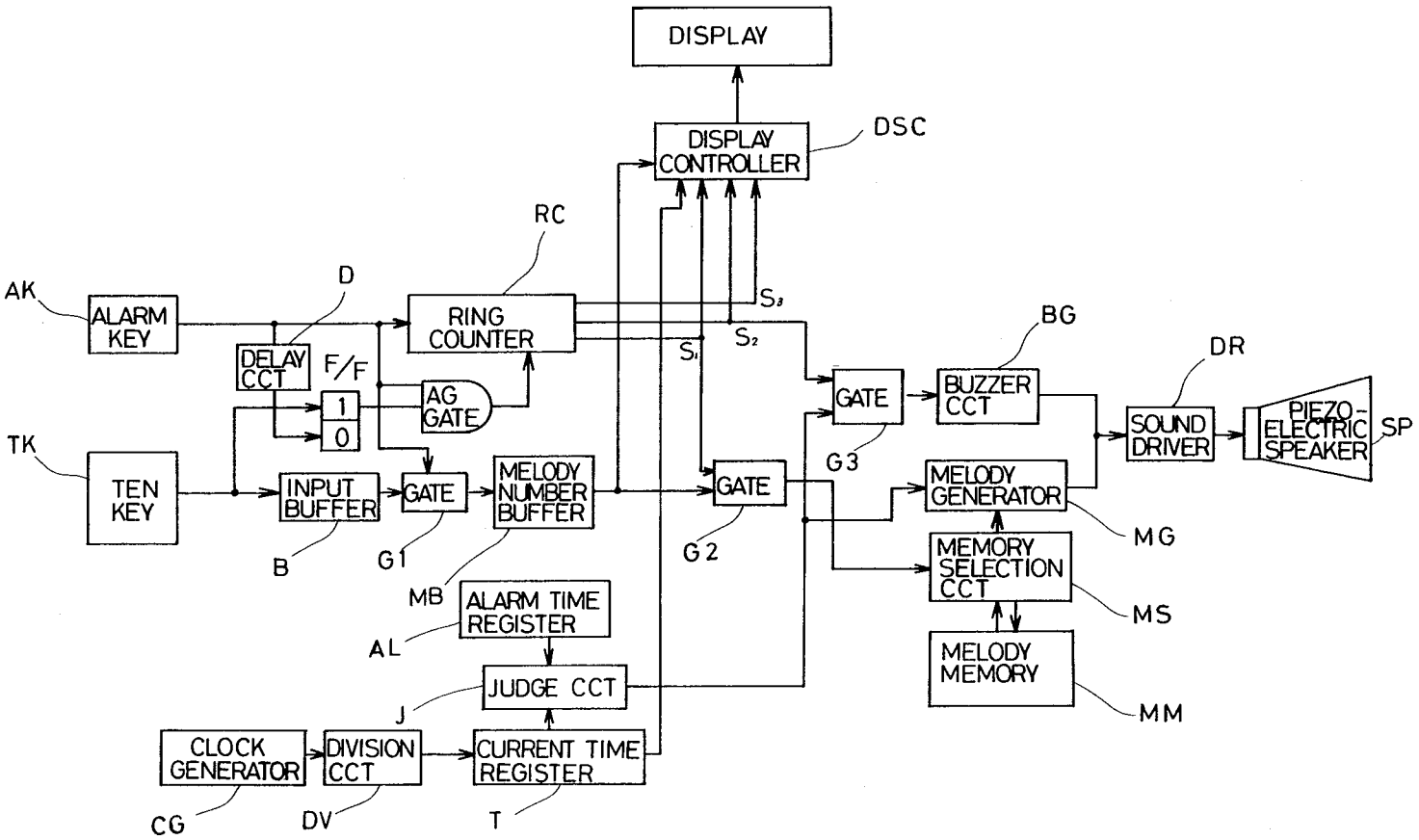

The present invention will be better understood from the detailed description given hereinbelow and the accompanying drawings which are given by way of illustration only, and thus are not limitative of the present invention and wherein:

FIG. 1 shows a plan view of a combined electronic calculator and electronic alarm timepiece according to the present invention; and FIG. 2 shows a block diagram of a circuit included within the combined electronic calculator and electronic alarm timepiece as shown in FIG. 1.

DESCRIPTION OF THE INVENTION

First of all, a conventional combined electronic calculator and electronic timepiece is disclosed in, for example, Maeda et al, U.S. Pat. No. 4,120,036 issued Oct. 10, 1978 and assigned to the present assignee, entitled "TIME INFORMATION CORRECTION IN COMBINATION TIMEPIECE AND CALCULATOR". The disclosure of this patent is incorporated herein by reference. Detailed description concerning the combined electronic calculator and electronic timepiece per se is omitted.

FIG. 1 shows a combined electronic calculator and electronic alarm timepiece according to the present invention. It comprises a numeral keyboard TK, function keyboard, and a display D.

The numeral keyboard TK comprises ten digit key switches from "0" to "9". The function keyboard is operated to cause various functions in a calculator mode. The function keyboard comprises an alarm key AK actuated to select alarm sounds or melodies. The display D is provided for displaying calculated results in the calculator mode and time information in a timepiece mode. In the timepiece mode, the display D can illuminate a symbol S indicating any selected alarm sounds or melodies. A mode selector is operated to select the calculator mode, the timepiece (clock) mode and a set mode for setting new time information thereto.

In the timepiece mode, the display D can show calendar information to provide a calendar clock.

Further, other necessary elements are required for the calculator mode, the timepiece mode, the set mode and other operations including a stop watch operation provided within the combined instrument of FIG. 1. Since the operations of these other elements are not related to the crux of the present invention, further description is omitted.

FIG. 2 shows a block diagram of a circuit within the combined electronic calculator and electronic alarm timepiece. This circuit enables the alarm sounds or melodies to be selected in the timepiece mode according to the present invention.

The circuit comprises a clock generator CG, a division circuit DV, and a current time register T all forming a conventional timepiece circuit. Current time information from the current time register T is applied to the display so as to display the current time information by operating a display controller DSC. The current time information is also admitted to a judge circuit J. The judge circuit J is provided for comparing the current time information and alarm time information. The alarm time information is set in an alarm time register AL. When these items of time information agree, the judge circuit J outputs a signal for making a gate $G_3$ conductive and for operating a melody generator MG.

A ring counter RC is provided for subsequently counting up, each time the alarm key AK is actuated, so that three different states are cyclically repeated in the counter RC. In the first state of the counter RC, it outputs a signal $S_1$ for providing a particular melody. The signal $S_1$ is applied to a gate $G_2$ and the display controller DSC. The gate $G_2$ is made conductive. The display shows a melody alarm symbol, say, a G clef indicating that an alarming tone is a melody.

In the second state of the ring counter RC, it outputs a signal $S_2$ for buzzing. The signal $S_2$ is applied to the gate $G_3$ and the display controller DSC. The gate $G_3$ is made conductive. The display shows a buzzer alarm symbol, say, an illustrated trumpet as indicated by S in FIG. 1 indicating that an alarming tone is a buzzer.

In the third state of the ring controller RC, it outputs a signal $S_3$ for keeping silence. The signal $S_3$ is applied to the display controller DSC.

The ten key TK is actuated to select a kind of melody by entering the number of the melody. The number of the melody entered by the ten key TK is stored in an input buffer B and applied to a flip flop to set the flip flop. Therefore, when the alarm key AK is actuated, a gate AG is conductive to provide a signal for placing the ring counter RC in the first state. The signal $S_1$ is generated from the counter RC. Simultaneously, in response to actuation of the alarm key AK, a gate $G_1$ is conductive so that the melody number in the input buffer B is transferred into a melody number buffer MB for storage. A delay circuit D is provided for resetting the flip flop.

The melody number in the melody number buffer MB is further transferred to the melody selection circuit MS through the gate $G_2$. As stated above, the gate $G_2$ is conductive in response to the application of the signal $S_1$ from the ring counter RC. The memory selection circuit MS addresses melody information from a melody memory MM, the melody information corresponding to the melody number. The melody information developed is sent to a melody generator MG.

A buzzer circuit BG is provided for generating buzzer information. The circuit BG is driven by the output from the gate $G_3$. A sound driver DR is provided for receiving the buffer information from the buzzer circuit BG or the melody information from the melody generator MG. The output from the sound driver DR is applied to a piezoelectric speaker SP to thereby provide a buzzer or a melody.

Any melody information can be stored in and developed from the melody memory MM. Since storage and developement of the melody information is described in, for example, Kapps U.S. Pat. No. 3,878,750 issued Apr. 22, 1975, entitled "PROGRAMMABLE MUSIC SYNTHESIZER", detailed description is omitted.

In operation, the alarm key AK is operated so that the ring counter RC develops the signal $S_1$. The display D shows the melody alarm symbol of the G clef and, simultaneously, the gate $G_2$ is conductive. The melody number stored in the melody number buffer MB is transferred to the melody selection circuit MS. The melody selection circuit MS addresses the corresponding melody information from the melody memory MM. The melody information is admitted to the melody generator MG through the melody selection circuit MS.

Under the circumstances, when the current time information agrees to the alarm time information set in the alarm time register AL, the judge circuit J develops an output signal to the melody generator MG. The generator MG is responsive to the output signal to provide melody signals corresponding to the melody information applied thereto. The melody signals are applied to the sound driver DR so that the piezoelectric speaker SP releases the melody.

Once the alarm key AK is further operated, the ring counter RC develops the signal $S_2$. The display D shows the buzzer alarm symbol of the trumpet S. When the current time information agrees to the alarm time information, the gate $G_3$ is conductive in response to the application of the signal $S_2$ and the output from the judge circuit J. The output from the gate $G_3$ activates the buzzer circuit BG, so that the piezoelectric speaker SP provides the buzzer.

When the alarm key AK is further operated, the ring counter RC develops the signal $S_3$ for keeping silence even when the current time information agree to the alarm time information.

Thus, according to the present invention, any desired alarm tone can be selected with a single key switch operation and done at any time as far as the timepiece mode is selected in the combined electronic calculator and electronic alarm timepiece. Further, the desired alarm tone can be selected individually apart from alarm time setting operations. In addition, just after the desired alarm tone is selected, the combined electronic calculator and electronic alarm timepiece is automatically placed in a waiting mode for generating the selected alarm tone once the current time information agrees to the alarm time information.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electronic alarm timepiece comprising:

clock means for developing current time information;

alarm generation means for generating a plurality of alarm tones;

means for introducing time information indicative of desired alarm times;

a bistable alarm selection switch;

alarm selection means, responsive to actuation of said bistable alarm selection switch, for selecting a particular alarm tone from the plurality of alarm tones and for enabling generation of the particular alarm tone in response to the agreement between current time information and alarm time information, the selection of the particular alarm tone within said plurality of alarm tones and the selective enabling of the generation of the particular alarm tone being carried out solely by actuation of said bistable alarm selection switch;

said alarm selection means including ring counter means for cyclically selecting a particular alarm tone from said plurality of alarm tones.

2. The timepiece of claim 1, further comprising an electronic calculator incorporated within the electronic alarm timepiece.

3. An electronic alarm timepiece comprising:

clock means for developing current time information;

alarm generation means for generating a plurality of alarm tones;

tone selection means for specifying a desired alarm tone from said plurality of alarm tones, said tone selection means including a bistable selection switch;

means for introducing alarm tone information indicative of desired alarm tones;

alarm selection means, responsive to the actuation of said bistable selection switch, for selecting a particular alarm tone in response to the agreement between current time information and alarm time information, the selection of the particular alarm tone and the selective enabling of the generation of the particular alarm tone being carried out solely by actuation of said bistable selection switch, said alarm selection means including ring counter means for cyclically selecting a particular alarm tone from said plurality of alarm tones.

4. The timepiece of claim 3, wherein said bistable switch is a key switch.

5. The timepiece of claim 3, wherein the alarm selection means comprises gate means for receiving a first output signal from the alarm generation means and a second output signal generated in response to the agreement between the current time information and the alarm time information.

6. An electronic alarm timepiece comprising:

alarm generation means for generating a plurality of alarm tones;

first means for selecting a desired alarm tone from said plurality of alarm tones and for selecting the absence of an alarm, when desired, by actuation of a single bistable switch, said first means including ring counter means for cyclically selecting a desired alarm tone from said plurality of alarm tones; and means, responsive to said means for selecting, for enabling generation of said desired alarm tone, when selected;

said alarm generation means generating at least one tone which producible as a plurality of melodies and including;

melody memory means for storing a plurality of melodies therein; and second means for selecting a desired melody from said plurality of melodies stored in said melody memory means.

7. The timepiece of claim 6 wherein said means for enabling includes gate means for each of said plurality of alarm tones for enabling generation of an alarm generation signal to enable generating of said desired alarm tone.

* * * * *